US011482203B2

(12) United States Patent
Lee et al.

(10) Patent No.: US 11,482,203 B2
(45) Date of Patent: Oct. 25, 2022

(54) SPARSE ACOUSTIC REFLECTOR

(71) Applicant: Toyota Motor Engineering & Manufacturing North America, Inc., Plano, TX (US)

(72) Inventors: Taehwa Lee, Ann Arbor, MI (US); Hideo Iizuka, Ann Arbor, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 257 days.

(21) Appl. No.: 16/875,073

(22) Filed: May 15, 2020

(65) Prior Publication Data

US 2021/0358468 A1 Nov. 18, 2021

(51) Int. Cl.

| | |
|---|---|
| ***E04B 1/82*** | (2006.01) |
| ***G10K 11/172*** | (2006.01) |
| *H04R 1/20* | (2006.01) |
| *G10K 11/162* | (2006.01) |

(52) U.S. Cl.

CPC ..... *G10K 11/172* (2013.01); *G10K 11/162* (2013.01)

(58) Field of Classification Search

CPC ..... G10K 11/172; G10K 11/162

USPC ..... 381/345; 181/286

See application file for complete search history.

(56) References Cited

U.S. PATENT DOCUMENTS

| | | | |
|---|---|---|---|
| 7,117,974 | B2 | 10/2006 | Moenssen et al. |
| 2019/0232580 | A1* | 8/2019 | Wilson ..... B29C 70/545 |
| 2019/0333491 | A1 | 10/2019 | Lee et al. |
| 2020/0202831 | A1 | 6/2020 | Lee et al. |

OTHER PUBLICATIONS

Cheng, Y et al., "Ultra-sparse metasurface for high reflection of low-frequency sound based on artificial Mie resonances," Nat. Mater., 14, pp. 1013-1020 (2015).

* cited by examiner

*Primary Examiner* — Ammar T Hamid

(74) *Attorney, Agent, or Firm* — Christopher G. Darrow; Darrow Mustafa PC

(57) ABSTRACT

A broadband sparse acoustic reflector includes a periodic array of laterally spaced apart unit cells, each unit cell having a plurality of longitudinally positioned Helmholtz resonators. Each unit cell includes a Helmholtz resonator having a neck that places the resonator interior in fluid communication with an ambient fluid, in the lateral direction. Each Helmholtz resonator of the unit cell has a different resonance frequency, providing broadband reflection.

20 Claims, 5 Drawing Sheets

FIG. 4A
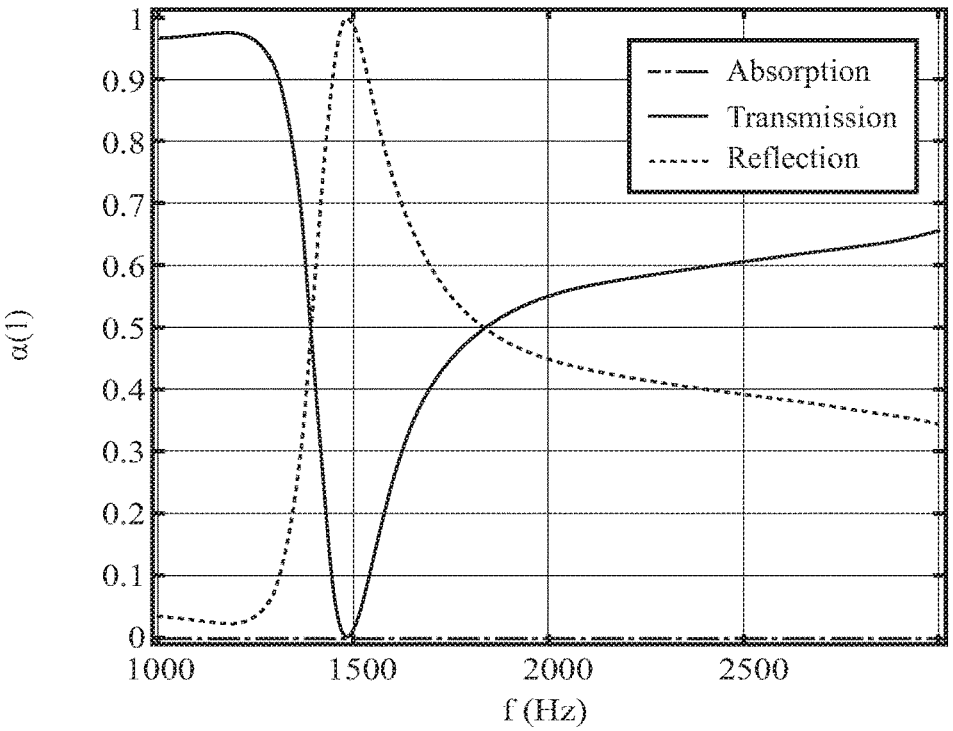
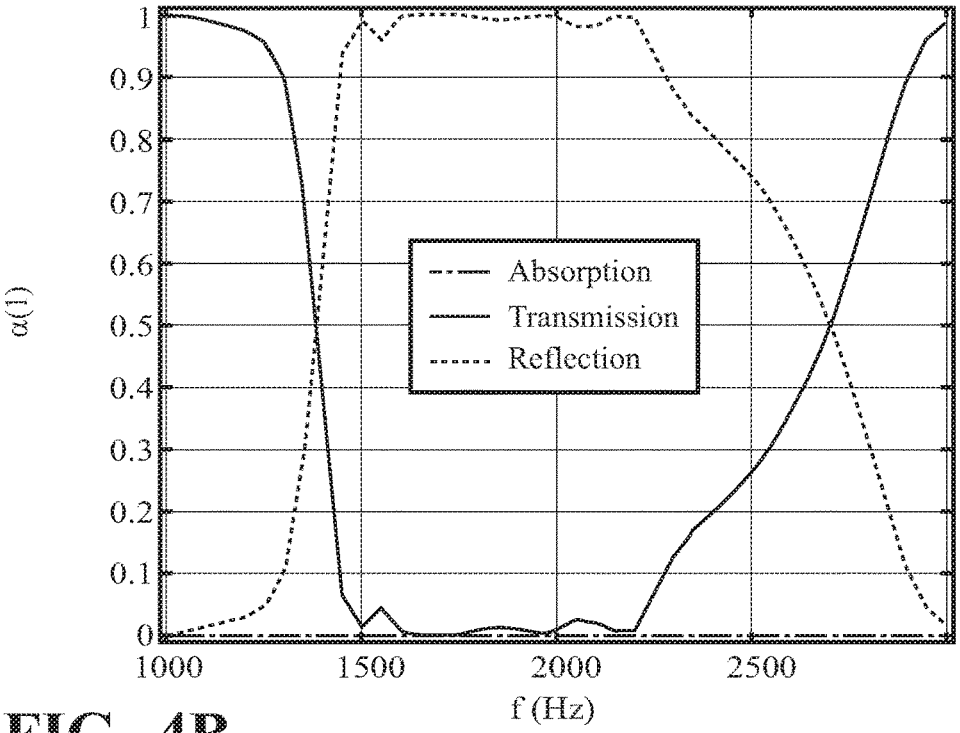
FIG. 4B

SPARSE ACOUSTIC REFLECTOR

TECHN1CAL FIELD

The present disclosure generally relates to reflective acoustic metamaterials and, more particularly, to such materials having broadband efficiency.

BACKGROUND

The background description provided herein is for the purpose of generally presenting the context of the disclosure. Work of the presently named inventors, to the extent it may be described in this background section, as well as aspects of the description that may not otherwise qualify as prior art at the time of filing, are neither expressly nor impliedly admitted as prior art against the present technology.

Efficient noise attenuation systems can use acoustic reflection, to redirect sound waves back toward their source. Such systems which are sparse, i.e. which contain substantial open space and are permeable to air or other ambient fluid, are particularly useful. Sparse systems having high reflection efficiency are rare. Sparse reflectors with broadband efficiency are particularly rare.

Accordingly, it would be desirable to provide an improved acoustic reflection system having sparse design and high reflection efficiency.

SUMMARY

This section provides a general summary of the disclosure, and is not a comprehensive disclosure of its fill scope or all of its features.

In various aspects, the present teachings provide a broadband sparse acoustic reflector. The reflector includes a periodic array of laterally spaced-apart unit cells. Each unit cell includes N Helmholtz resonators, longitudinally positioned relative to one another, wherein N is an integer greater than one. Each Helmholtz resonator includes at least one side wall enclosing and defining a chamber having a chamber volume. Each Helmholtz resonator further includes a lateral neck forming an opening in a lateral direction in the at least one side wall. The neck places the chamber in fluid communication with an ambient environment. Each Helmholtz resonator of the unit cell has resonance frequency described by the equation $$f_N = \frac{c}{2\pi}\sqrt{\frac{A_N}{V_N L_N}},$$

wherein $f_N$ is the resonance frequency of the $N^{th}$ Helmholtz resonator; c is the speed of sound in an ambient fluid in which the reflector is immersed; $A_N$ is the cross-sectional area of the neck of the $N^{th}$ Helmholtz resonator; $V_N$ is the chamber volume of the $N^{th}$ Helmholtz resonator; and $L_N$ is the neck length of the $N^{th}$ Helmholtz resonator. The resonance frequency of each $N^{th}$ Helmholtz resonator differs from the resonance frequency of at least one other $N^{th}$ Helmholtz resonator.

In other aspects, the present teachings provide a broadband sparse acoustic reflector. The reflector includes N longitudinally positioned periodic arrays of unit cells spaced apart in a lateral direction, wherein N is an integer greater than one. Each of the N longitudinally positioned periodic arrays is configured to reflect sound incident from a direction orthogonal to the lateral direction. Each of the each unit cell includes a Helmholtz resonator. Each Helmholtz resonator has at least one side wall enclosing and defining a chamber having a chamber volume. Each unit cell further has a lateral neck forming an opening in the at least one side wall in the lateral direction. The neck places the chamber in fluid communication with an ambient environment. Each Helmholtz resonator in an $N^{th}$ periodic array has a resonance frequency substantially the same as each other Helmholtz resonator in the same $N^{th}$ periodic array. The resonance frequency is described by the equation $$f = \frac{c}{2\pi}\sqrt{\frac{A}{VL}},$$

wherein f is the resonance frequency of the Helmholtz resonator; c is the speed of sound in an ambient fluid in which the reflector is immersed; A is the cross-sectional area of the neck; V is the chamber volume; and L is the neck length.

In still other aspects, the present teachings provide a sparse acoustic reflector. The reflector includes a one-dimensional periodic array of unit cells configured to reflect incident. The array has a direction of periodicity. Each unit cell is formed primarily of one Helmholtz resonator. Each Helmholtz resonator has at least one sidewall enclosing and defining a chamber having a chamber volume. Each Helmholtz resonator further has a lateral neck forming an opening in the at least one side wall. The opening is in the direction of periodicity, and the neck places the chamber in fluid communication with an ambient environment.

Further areas of applicability and various methods of enhancing the disclosed technology will become apparent from the description provided herein. The description and specific examples in this summary are intended for purposes of illustration only and are not intended to limit the scope of the present disclosure.

BRIEF DESCRIPTION OF THE DRAWINGS

The present teachings will become more fully understood from the detailed description and the accompanying drawings, wherein:

FIG. 4A is a graph of acoustic response, as a function of frequency, for a reflector of the type shown in FIGS. 1A-1C; and FIG. 4B is a graph of acoustic response, as a function of frequency, for a reflector of the type shown in FIGS. 2A and 2B.

It should be noted that the figures set forth herein are intended to exemplify the general characteristics of the methods, algorithms, and devices among those of the present technology, for the purpose of the description of certain aspects. These figures may not precisely reflect the characteristics of any given aspect, and are not necessarily intended to define or limit specific embodiments within the scope of this technology. Further, certain aspects may incorporate features from a combination of figures.

DETAILED DESCRIPTION

The present technology provides resonant sound reflection structures, and particularly such structures with broadband reflective efficiency. The structures include periodic arrays, with open space between adjacent, resonant unit cells, allowing fluid to flow freely through the structures. The structures can be easily adapted to a desired frequency, and, in various embodiments, can be designed for high acoustic reflection efficiency across a broadband frequency range.

Sparse acoustic reflectors of the present teachings have arrays of Helmholtz resonators, with necks perpendicular to the direction of incident acoustic wave propagation. Such unit cells can optionally include stacked Helmholtz resonators of differing resonant frequency, thereby conferring broadband reflection capability. The broadband sparse reflection structures have unique utility in any application that benefits from sound dampening, while allowing air or other fluid to pass freely through.

Figure 1A:
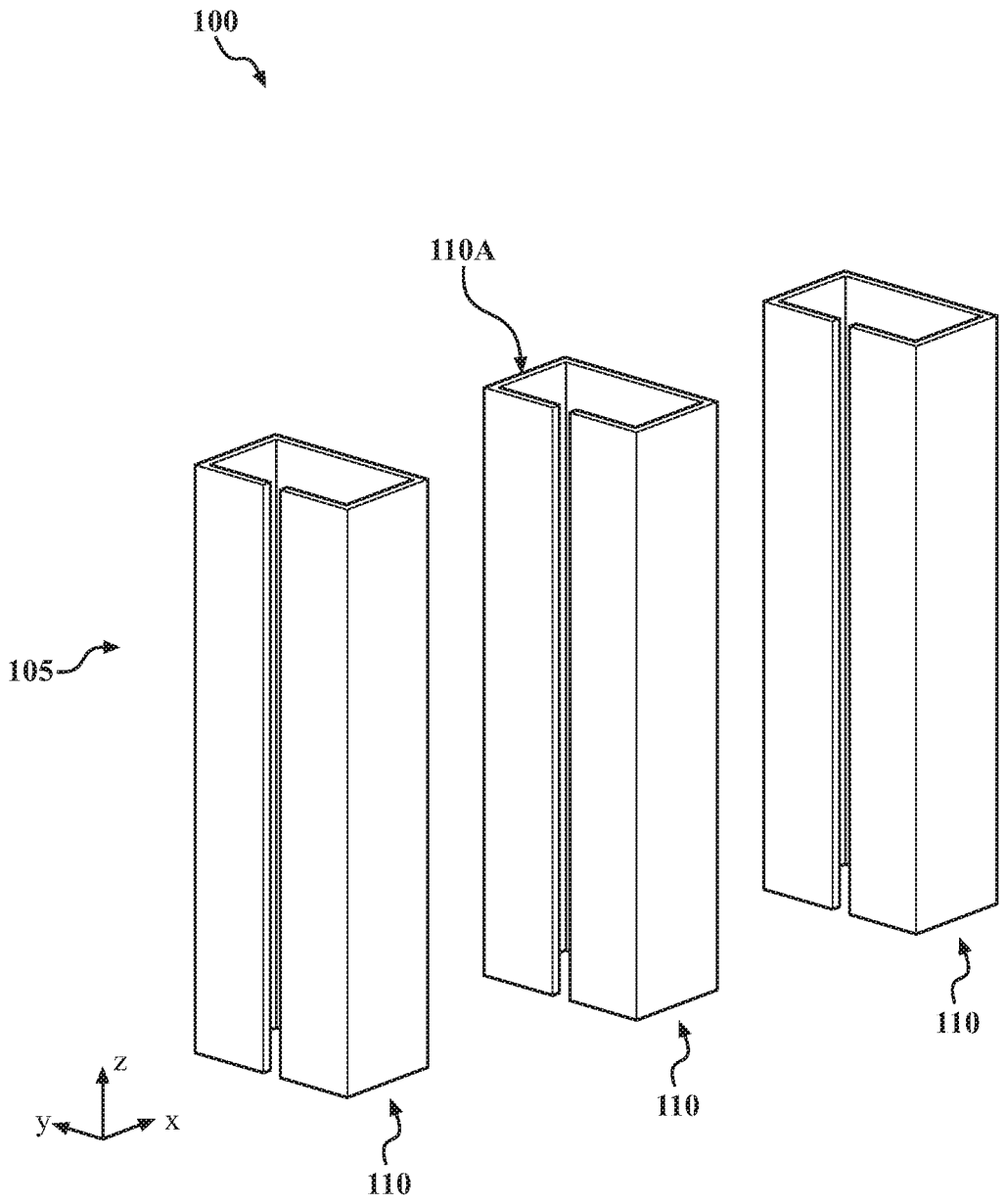
FIG. 1A is a perspective view of several unit cells of a one-dimensional array of resonant reflectors constituting a sparse acoustic reflector structure of the present teachings.
Figure 1B:
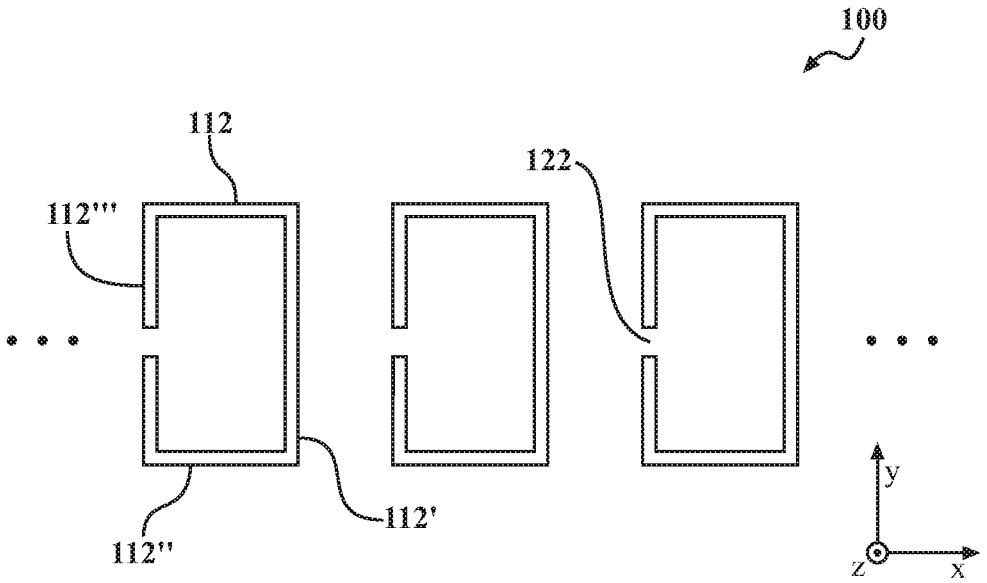
FIG. 1B is a top plan view of the unit cells of FIG. 1A.
Figure 1C:
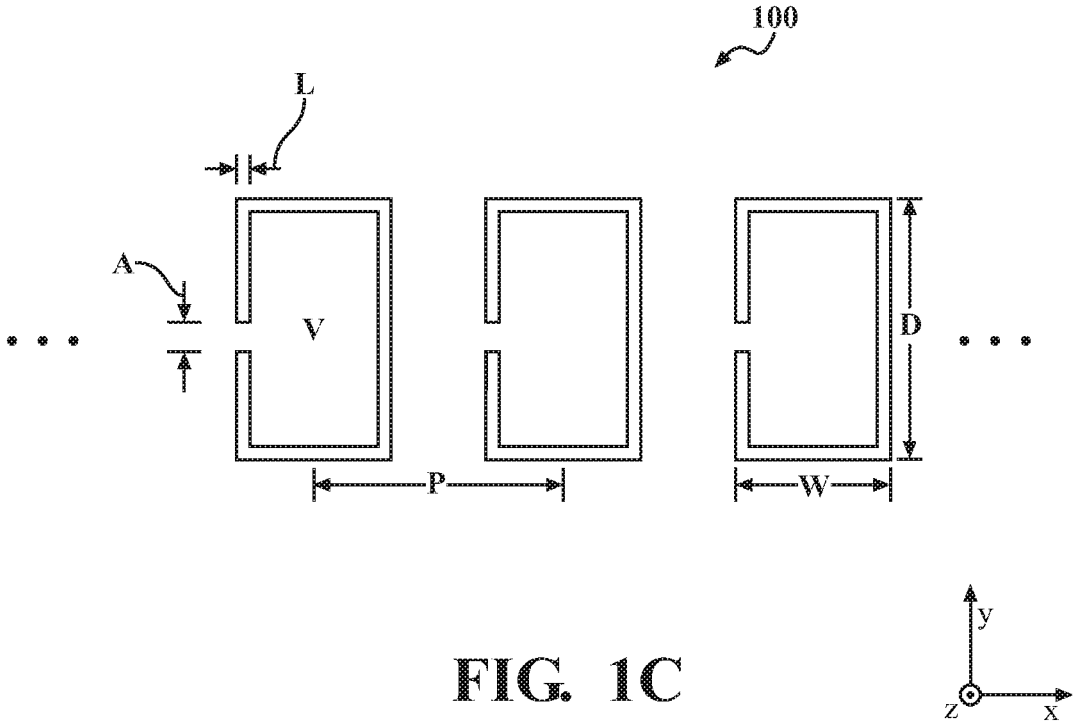
FIG. 1C is the top plan view of FIG. 1B, with geometric parameters labeled.

FIG. 1A is a perspective view of a portion of an exemplary sparse acoustic reflector 100 of the present teachings, and FIGS. 1B and 1C are top plan views of the same portion of the exemplary sparse acoustic reflector 100. The sparse acoustic reflector 100 of FIGS. 1A-1C includes a one-dimensional array 105 of periodic, laterally spaced apart unit cells 110. FIGS. 1A-1C show three periodic unit cells 110 of the array 105, each unit cell 110 including a Helmholtz resonator 110A. The array 105 can be considered to have a lateral direction (corresponding to the x-dimension of FIGS. 1A-1C) and a longitudinal direction (corresponding to the y-dimension of FIGS. 1A-1C).

Each Helmholtz resonator 110A includes at least one side wall 112, forming a columnar structure having a height in the z-dimension of FIGS. 1A-1C. The unit cells 110 are laterally arrayed (as noted, referring to periodicity in the x-dimension of FIGS. 1A-1C). In the example of FIGS. 1A-1C, and with particular reference to FIG. 1B, the exemplary Helmholtz resonators 110A have four side walls 112, 112', 112", 112'". It will be noted that end walls are present on each Helmholtz resonator 110A, but are omitted from FIGS. 1A-1C, and the drawings generally, to enable viewing the Helmholtz resonator 110A interior.

The at least one side wall 112 defines a chamber having a chamber volume, V. Each unit cell further has a neck 122 oriented perpendicular to the desired direction of incident sound. The neck 122 has a length, L, and an area, A. In the example of FIGS. 1A-1C, the neck length, L, is determined by the thickness of the at least one side wall 112, however the neck length could be varied by decreasing side wall thickness near the neck, or by adding extending walls to lengthen the neck. It will be understood that each Helmholtz resonator 110A has a resonance frequency described by Equation 1:

$$f = \frac{c}{2\pi}\sqrt{\frac{A}{VL}}, \qquad \text{Equation 1}$$

where f is the resonance frequency of the Helmholtz resonator; c is the speed of sound in the ambient fluid; A is the cross-sectional area of the neck; V is the chamber volume; and L is the neck length.

It will be understood that in instances where the neck 122 has a height (maximum distance in the z-dimension of FIGS. 1A-1C equal to the height of the Helmholtz resonator 110A, Equation 1 simplifies to Equation 2:

$$f = \frac{c}{2\pi}\sqrt{\frac{S}{aL}}, \qquad \text{Equation 2}$$

where S is the width of the neck and a is the cross-sectional area of the chamber interior, in the x-y plane of FIGS. 1A-1C. As such, when the height of the neck 122 is equal to the height of the Helmholtz resonator 110A (i.e. the neck runs the length of the resonator, from top-to-bottom), the resonator 110A frequency is independent of the Helmholtz resonator 110A height.

With particular reference to FIG. 1C, the array 105 of unit cells 110 defines a fill factor, W/P, where W is the exterior width of individual unit cells and P is the period of the array 105. The period, P, of the periodic array 105 of unit cells 110 will generally be substantially smaller than the wavelength of the acoustic waves that the sparse acoustic reflector 100 is designed to reflect. As shown in FIG. 1C, the period can be equated to a center-to-center distance between adjacent unit cells. A unit cell 110 can further be characterized as having a depth, D. In different implementations, the period of the periodic array 105 of unit cells 110 will be within a range of from about 0.1 to about 0.75, inclusive, of the wavelength of the acoustic waves that the sparse acoustic reflector 100 is designed to reflect, i.e. the wavelength corresponding to the resonance frequency discussed above. In certain particular implementations, the period of the periodic array 105 of unit cells 110 will be within a range of from about 0.25 to about 0.5 of the resonance wavelength example, in some implementations, the sparse acoustic reflector 100 can be designed to reflect acoustic waves of a human-audible frequency, having a wavelength within a range of from about 17 mm to about 17 m, or some intermediate value contained within this range.

In general, the fill factor will be 0.5 or less. In some implementations, the fill factor will be 0.25 (i.e. 25%) or less. it will be appreciated that the frequency breadth of efficient reflection of the sparse acoustic reflector 100 (i.e. the broadband nature of reflection) is substantially determined by the fill factor of the periodic array 105 of unit cells 110; the ratio of width to period of unit cells 110. Thus, a large fill factor (W/P) increases the frequency bandwidth, whereas a small fill factor (high sparsity) decreases the bandwidth of efficient reflection. As noted above, the period of the periodic array 105 of unit cells 110 is smaller than the wavelength corresponding to the desired resonance frequency (period<wavelength). At the same time, in many implementations the period and width of unit cells 110 will be chosen so that the periodic array 105 of unit cells 110 has a fill factor of at least 0.2 (i.e. 20%).

In some implementations, the unit cells 110 of a sparse acoustic reflector 100 can be positioned periodically on a porous substrate, through which ambient fluid can pass with little constraint. Such a porous substrate could be a mesh or screen, such as an air screen of the type used in a window, a sheet of material having periodic apertures or perforations, or any other suitable substrate.

While the unit cell 110 of FIGS. 1A and 1B defines a substantially rectangular prismatic shape, it is to be understood that a unit cell 110 of the present teachings can include any suitable shape, such as cylindrical, conical, spherical, ovoid, or any other shape that is suitable to the chamber of the Helmholtz resonators 110A.

It is further to be understood that the term "unit cell" is used somewhat loosely herein. It is generally desirable that the array 105 have a regular period, with consistent center-to-center spacing between adjacent unit cells 110. It is further generally desirable that the Helmholtz resonators 110A of an array 105 have matching frequencies, and that their necks 122 be laterally oriented. However, different unit cells 110 of an array 105 can optionally have different geometry, as long as matching frequency is maintained. For example, in instances where the unit cell 110 has a single Helmholtz resonator 110A, some of the Helmholtz resonators 110A could have twice the chamber volume, V, of others, while also having twice the neck 122A surface area, A, thus maintaining matching resonance frequency.

It will be noted that in the example of FIGS. 1A-1C, all of the necks 122 point in the same direction "left" in the view of FIGS. 1B and 1C). In some implementations, necks 122A can variably point in opposite, lateral directions (i.e. "left" or "right", according to the view of FIGS. 1B and 1C). It will also be noted that, in the example of FIGS. 1A-1C, the necks 122 of the Helmholtz resonators 110A are coplanar (i.e. have the same position in the y-dimension)

The at least one side wall 112, as well as end walls, will typically be formed of a solid, sound reflecting material. In general, this material will have acoustic impedance higher than that of ambient fluid, e.g. air. Such materials can include a thermoplastic resin, such as polyurethane, a ceramic, or any other suitable material.

Figure 2A:
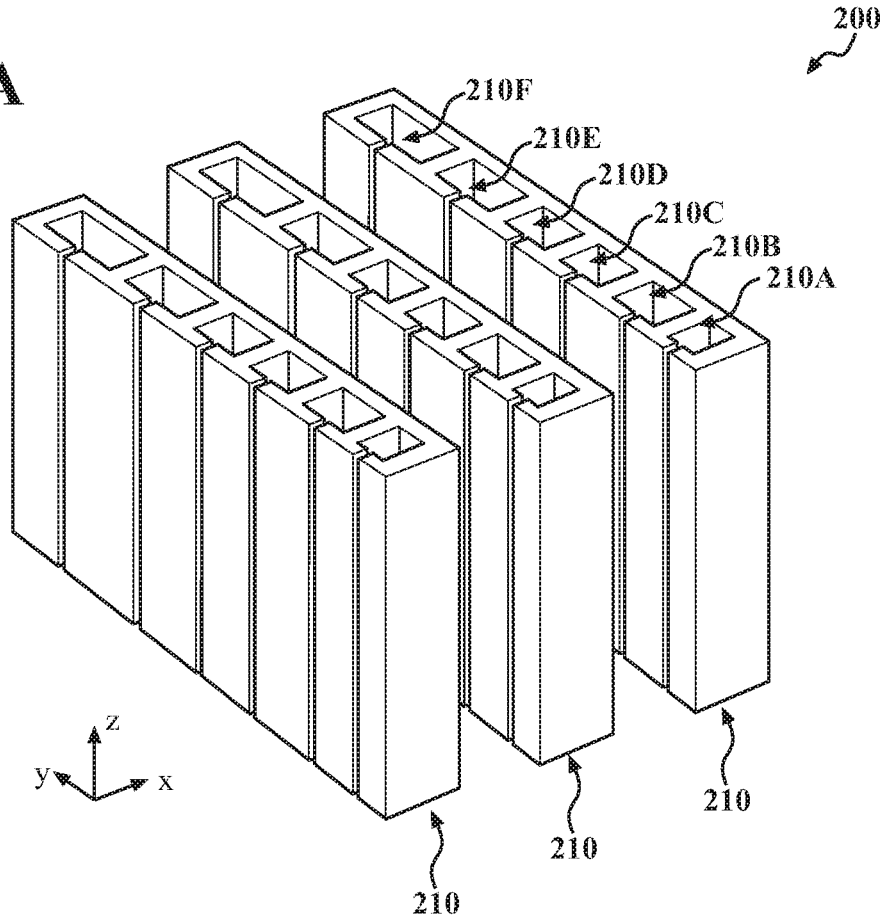
FIG. 2A is a perspective view of several unit cells of a broadband sparse acoustic reflector, each unit cell having multiple resonant reflectors of differing resonance frequency.
Figure 2B:
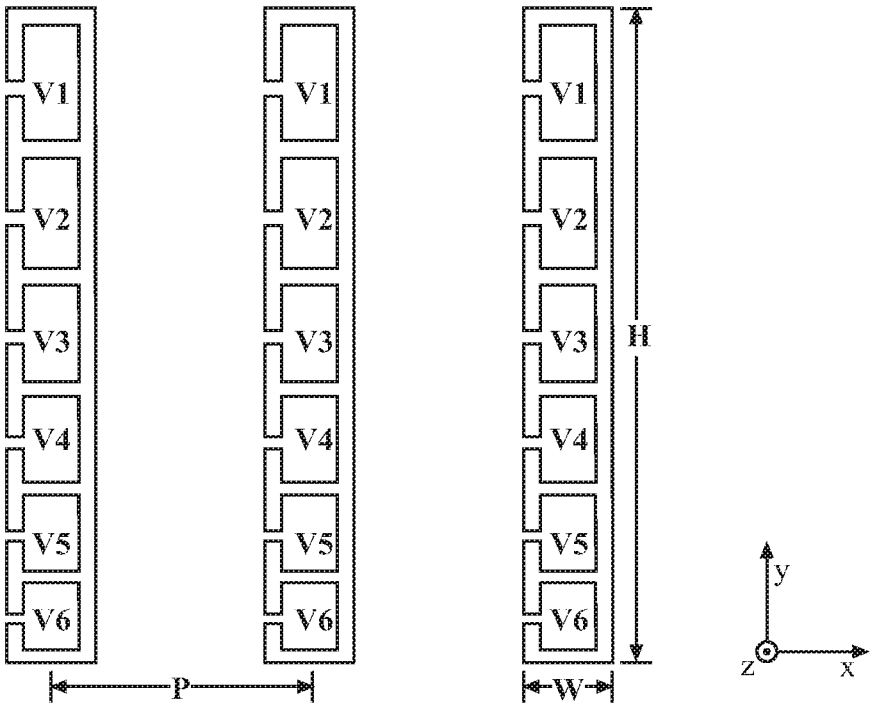
FIG. 2B is a top plan view of the several unit cells of FIG. 2A.

In some implementations, a broadband sparse acoustic reflector 200, having a one dimensional array 105 of unit cells 110 as described above, can include unit cells 110 in which a stack of N Helmholtz resonators 110A of differing frequency broaden the wavelength range of efficient reflection. In such implementations, N is an integer greater than one. FIG, 2A illustrates a perspective view of such a broadband sparse acoustic reflector 200 in which N equals six, while FIG. 2B illustrates a top plan view of the broadband sparse acoustic reflector of FIG. 2A. As shown in FIGS. 2A and 2B, the broadband sparse acoustic reflector has periodic unit cells 210, each having a plurality of Helmholtz resonators 210A, 210B, 210C, 210D, 210E, 210F. Each of the plurality of Helmholtz resonators 210A-210F has a different resonance frequency, as described by Equation 3:

$$f_N = \frac{c}{2\pi}\sqrt{\frac{A_N}{V_N L_N}}, \qquad \text{Equation 3}$$

where $f_N$ is the resonance frequency of the $N^{th}$ Helmholtz resonator in the unit cell 110; $A_N$ is the cross-sectional area of the neck of the $N^{th}$ Helmholtz resonator in the unit cell 110; $V_N$ is the chamber volume of the $N^{th}$ Helmholtz resonator in the unit cell 110; and $L_N$ is the neck length of the $N^{th}$ Helmholtz resonator in the unit cell 110.

With reference to Equation 3, it will be noted that individual Helmholtz resonators 210A, 210B, 210C, 210D, 210E, 210F can have different resonance frequencies by virtue of different chamber volumes, $V_N$; different neck lengths, $L_N$; different neck surface areas, $A_N$; or by differences in any combinations of these features. In the example of FIG. 2B, the differing frequencies, $f_N$, are due to differences in chamber volume, $V_N$. In particular, the Helmholtz resonators 210A-210F of FIGS. 2A and 2B have identical neck lengths and surface areas, but different chamber volumes V1, V2, V3, V4, V5, and V6, giving rise to different resonance frequencies.

It will be understood that Equation 3 is a variation of Equation 1, and that Equation 2 can be similarly varied as Equation 4, to describe resonance frequency, $f_N$, for each $N^{th}$ Helmholtz resonator in a broadband sparse acoustic reflector 200 in which each of the necks 122 has height equivalent to that of its Helmholtz resonator 110A:

$$f_N = \frac{c}{2\pi}\sqrt{\frac{S_N}{a_N L_N}}, \qquad \text{Equation 4}$$

where $a^N$ is the cross-sectional area of the $N^{th}$ Helmholtz resonator in the unit cell 110, and $S_N$ is the width of the neck 122 of the $N^{th}$ Helmholtz resonator in the unit cell 110.

It will be understood that the descriptions of width, W, period, P, and fill factor, W/P that are described above with respect to the sparse acoustic reflector 100 are similarly applicable to the broadband sparse acoustic reflector 200 of FIGS. 2A and 2B. And while the dimensions of the sparse acoustic reflector 100 are discussed in relation to the resonance frequency, they are equally applicable to the broadband sparse acoustic reflector 200 in relation to any of the $f_N$ resonance frequencies.

Figure 3A:
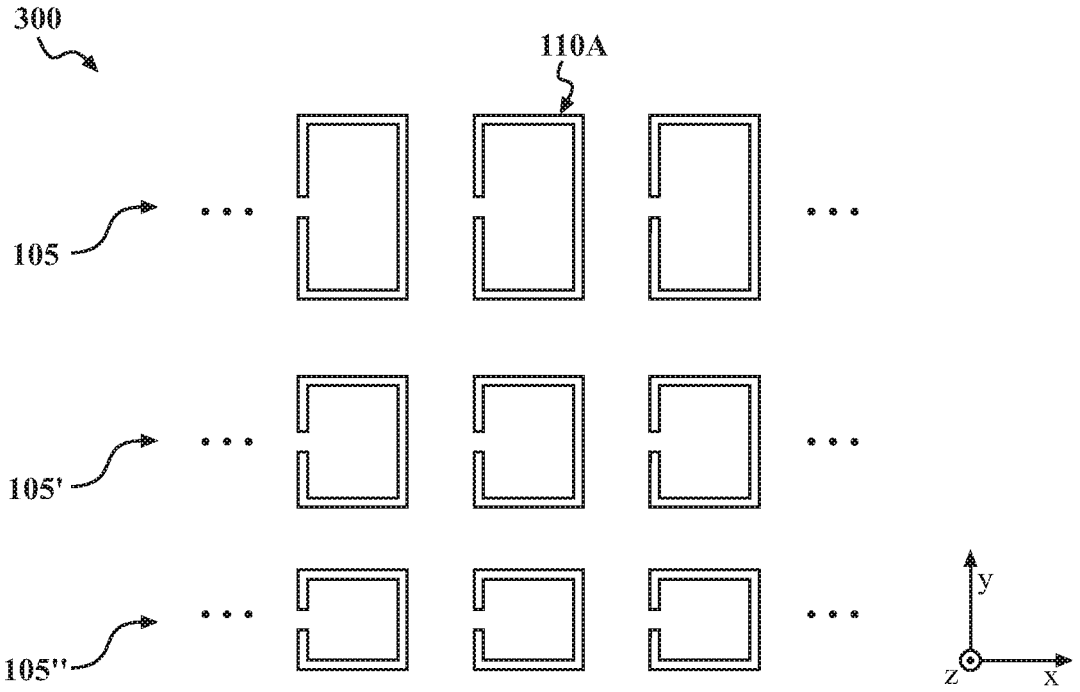
FIG. 3A is a top plan view of a broadband sparse acoustic reflector having a plurality of one-dimensional arrays of Helmholtz resonators with the resonators of each array in-line with the resonators of each other array.
Figure 3B:
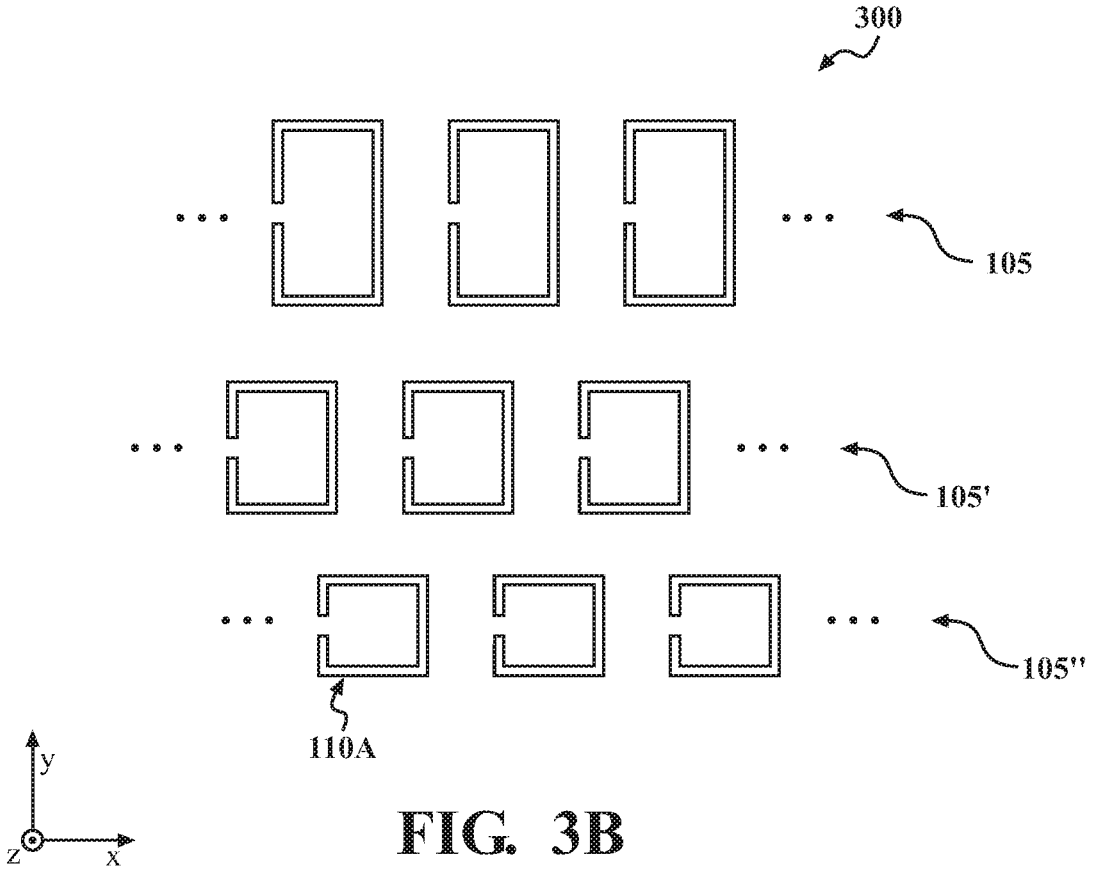
FIG. 3B is a top plan view of a broadband sparse acoustic reflector having a plurality of one-dimensional arrays of Helmholtz resonators with the resonators of each array offset from the resonators of each other array.

While the exemplary broadband sparse acoustic reflector 200 of FIGS, 2A and 2B show N Helmholtz resonators 110A contacting one another, in linear longitudinal arrangement, broadband acoustic resonators of the present teachings can have alternative arrangements. FIGS. 3A and 3B show top plan views of broadband sparse reflector 300 having N longitudinally positioned periodic arrays 105. Each periodic array 105 of the broadband sparse reflector of FIGS. 3A and 3B is as described above.

In the examples of FIGS. 3A and 3B, N equals three, as there are three longitudinally positioned periodic arrays 105, 105', and 105". In the example of FIG. 3A, the N longitudinally positioned arrays are laterally aligned. This means that every unit cell 110 of the $N+1^{th}$ longitudinally positioned array is directly behind, or in-line with, a unit cell of the $N^{th}$ longitudinally positioned array in the longitudinal direction (i.e. in the y-dimension of FIGS. 3A and 3B). In the example of FIG. 3B, the N longitudinally positioned arrays are laterally offset. This means that every unit cell 110 of the $N+1^{th}$ longitudinally positioned array is not directly behind, or in-line with, a unit cell of the $N^{th}$ longitudinally positioned array in the longitudinal direction, but instead occupies a different position in the lateral direction (i.e. in the x-dimension of FIGS. 3A and 3B).

It can be seen that, in the examples of FIGS. 3A and 3B, the N longitudinally positioned arrays 105, 105', 105" are longitudinally spaced apart, such that they do not contact one another. In some variations, the broadband sparse acoustic absorber having N longitudinally positioned arrays can have longitudinally positioned arrays in contact with one another. It will be understood that the broadband sparse acoustic reflector of FIGS. 2A and 2B can be regarded as a variant of this type, in which Helmholtz resonators 110A of adjacent longitudinally positioned arrays are connected together with a shared side wall 112.

FIG. 4A shows a plot of acoustic response as a function of wavelength for a sparse acoustic reflector 100 of the type shown in FIGS. 1A-1C. The heights of the Helmholtz resonators 110A and their necks 122 are the same, so that resonance frequency is independent of resonator height, as described above in conjunction with Equation 2. The dimensions of the device are given by W=15 mm, D=30 mm, S=1 mm, L=2 mm, and a=324 $mm^2$ (12×27). The Helmholtz resonators 110A have a resonance frequency of 1500 Hz, which can be predicted using adjusted neck length (slightly larger than L) in the equation presented. The adjusted neck length accounts for the vibrating mass extending outside the neck. The results in FIG. 3A show near unity reflection, and no transmission, at the resonance frequency. It will be noted that the bandwidth is somewhat narrow, with <50% reflection at frequencies more than a few hundred Hz removed from the resonance frequency.

FIG. 4B shows a plot of acoustic response as a function of wavelength for a broadband sparse acoustic reflector 200 of the type shown in FIGS. 2A and 2B. The results of FIG. 4B show a broadband reflection response with near-unity reflection across a range of from about 1500 to about 2200 Hz, with no transmission in this range. As was the case for the sparse acoustic reflector 100 of FIG. 3A, for the broadband sparse acoustic reflector 200 of FIG. 4B, the Helmholtz resonators 210A, 210B, 210C, 210D, and 210E, and their necks 122 have identical heights, so that resonance frequency is independent of resonator height. The dimensions are given by W=15 mm, D=105 mm, S=1 mm, L=2 mm, and cross-sectional internal chamber areas are: a1=324 $mm^2$ (12×27); a2=276 $mm^2$ (12×23), a3=228 $mm^2$ (12×19), a4=180 $mm^2$ (12×15), a5=132 $mm^2$ (12×11). It will be understood that a1, a2, etc., as listed above, are analogous to V1, V2, etc. of FIG. 2B, but represent cross-sectional chamber areas, analogous to chamber volumes, V, as described above in relation to Equation 4, in the example where neck height is equal to Helmholtz resonator height.

The preceding description is merely illustrative in nature and is in no way intended to limit the disclosure, its application, or uses. As used herein, the phrase at least one of A, B, and C should be construed to mean a logical (A or B or C), using a non-exclusive logical "or." It should be understood that the various steps within a method may be executed in different order without altering the principles of the present disclosure. Disclosure of ranges includes disclosure of all ranges and subdivided ranges within the entire range.

The headings (such as "Background" and "Summary") and sub-headings used herein are intended only for general organization of topics within the present disclosure, and are not intended to limit the disclosure of the technology or any aspect thereof. The recitation of multiple embodiments having stated features is not intended to exclude other embodiments having additional features, or other embodiments incorporating different combinations of the stated features.

As used herein, the terms "comprise" and "include" and their variants are intended to be non-limiting, such that recitation of items in succession or a list is not to the exclusion of other like items that may also be useful in the devices and methods of this technology. Similarly, the terms "can" and "may" and their variants are intended to be non-limiting, such that recitation that an embodiment can or may comprise certain elements or features does not exclude other embodiments of the present technology that do not contain those elements or features.

The broad teachings of the present disclosure can be implemented in a variety of forms. Therefore, while this disclosure includes particular examples, the true scope of the disclosure should not be so limited since other modifications will become apparent to the skilled practitioner upon a study of the specification and the following claims. Reference herein to one aspect, or various aspects means that a particular feature, structure, or characteristic described in connection with an embodiment or particular system is included in at least one embodiment or aspect. The appearances of the phrase "in one aspect" (or variations thereof) are not necessarily referring to the same aspect or embodiment. It should be also understood that the various method steps discussed herein do not have to be carried out in the same order as depicted, and not each method step is required in each aspect or embodiment.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations should not be regarded as a departure from the disclosure, and all such modifications are intended to be included within the scope of the disclosure.

What is claimed is:

1. A broadband sparse acoustic reflector comprising a periodic array of laterally spaced-apart unit cells, each unit cell comprising:

N Helmholtz resonators, wherein N is an integer greater than one, longitudinally positioned relative to one another, each Helmholtz resonator comprising:

at least one side wall enclosing and defining a chamber having a chamber volume; and a lateral neck forming an opening in a lateral direction in the at least one side wall, the neck placing the chamber in fluid communication with an ambient environment, wherein each Helmholtz resonator of the unit cell has resonance frequency described by the equation:

$$f_N = \frac{c}{2\pi}\sqrt{\frac{A_N}{V_N L_N}}$$

wherein $f_N$ is the resonance frequency of the $N^{th}$ Helmholtz resonator; c is the speed of sound in an ambient fluid in which the broadband sparse acoustic reflector is immersed; $A_N$ is the cross-sectional area of the neck of the $N^{th}$ Helmholtz resonator; $V_N$ is the chamber volume of the $N^{th}$ Helmholtz resonator; and $L_N$ is the neck length of the $N^{th}$ Helmholtz resonator, and wherein the resonance frequency of each $N^{th}$ Helmholtz resonator differs from the resonance frequency of at least one other $N^{th}$ Helmholtz resonator.

2. The broadband sparse acoustic reflector as recited in claim 1, wherein each Helmholtz resonator of the unit cell has a different chamber volume from at least one other Helmholtz resonator of the unit cell.

3. The broadband sparse acoustic reflector as recited in claim 1, wherein the resonance frequency of each Helmholtz resonator of the unit cell differs from the resonance frequency of each other Helmholtz resonator of the unit cell.

4. The broadband sparse acoustic reflector as recited in claim 1, wherein each $N^{th}$ Helmholtz resonator of the array has equal chamber volume, neck length, and neck surface area.

5. The broadband sparse acoustic reflector as recited in claim 1, wherein each neck has a height equal to a height of its respective Helmholtz resonator, so that the resonance frequency of each Helmholtz resonator is independent of resonator height.

6. The broadband sparse acoustic reflector as recited in claim 1, wherein the periodic array has a period, P, equal to about 0.5 times a wavelength corresponding to the resonance frequency of at least one Helmholtz resonator.

7. The broadband sparse acoustic reflector as recited in claim 1, wherein the periodic array has a period, P, equal to about 0.25 times a wavelength corresponding to the resonance frequency of at least one Helmholtz resonator.

8. The broadband sparse acoustic reflector as recited in claim 6, wherein the periodic array defines a fill factor equal to W/P where W is a width of the unit cell, and wherein the fill factor is less than 0.5.

9. The broadband sparse acoustic reflector as recited in claim 8, wherein the fill factor is less than about 0.25.

10. A broadband sparse acoustic reflector, comprising:

N longitudinally positioned periodic arrays of unit cells spaced apart in a lateral direction, wherein N is an integer greater than one, each of the N longitudinally positioned periodic arrays configured to reflect sound incident from a direction orthogonal to the lateral direction, each of the each unit cell comprising:

a Helmholtz resonator having:

at least one side wall enclosing and defining a chamber having a chamber volume; and a lateral neck forming an opening in the at least one side wall in the lateral direction, the neck placing the chamber in fluid communication with an ambient environment, wherein each Helmholtz resonator in an $N^{th}$ periodic array has a resonance frequency substantially the same as each other Helmholtz resonator in the same $N^{th}$ periodic array, the resonance frequency described by the equation:

$$f = \frac{c}{2\pi}\sqrt{\frac{A}{VL}}$$

wherein f is the resonance frequency of the Helmholtz resonator; c is the speed of sound in an ambient fluid in which the broadband sparse acoustic reflector is immersed; A is the cross-sectional area of the neck; V is the chamber volume; and L is the neck length.

11. The broadband sparse acoustic reflector as recited in claim 10, wherein each $N^{th}$ array is longitudinally spaced apart from an $N+1^{th}$ array.

12. The broadband sparse acoustic reflector as recited in claim 10, wherein each $N^{th}$ array is in-line with an $N+1^{th}$ array.

13. The broadband sparse acoustic reflector as recited in claim 10, wherein each $N^{th}$ array is laterally offset from an $N+1^{th}$ array.

14. The broadband sparse acoustic reflector as recited in claim 10, wherein each Helmholtz resonator of the same $N^{th}$ array has a different chamber volume from each Helmholtz resonator of an $N+1^{th}$ array.

15. The broadband sparse acoustic reflector as recited in claim 10, wherein the resonance frequency of each Helmholtz resonator of the same $N^{th}$ array differs from the resonance frequency of each Helmholtz resonator of an $N+1^{th}$ array.

16. The broadband sparse acoustic reflector as recited in claim 10, wherein each Helmholtz resonator of the same $N^{th}$ array has equal chamber volume, neck length, and neck surface area.

17. The broadband sparse acoustic reflector as recited in claim 10, wherein each neck has a height equal to a height of its respective Helmholtz resonator, so that the resonance frequency of each Helmholtz resonator is independent of resonator height.

18. A sparse acoustic reflector comprising a one-dimensional periodic array of unit cells configured to reflect sound incident from a direction orthogonal to the lateral direction, the one-dimensional periodic array having a direction of periodicity, each unit cell consisting essentially of:

one Helmholtz resonator having:

at least one side wall enclosing and defining a chamber having a chamber volume; and a lateral neck forming an opening in the at least one side wall, the opening in the direction of periodicity, the neck placing the chamber in fluid communication with an ambient environment.

19. The sparse acoustic reflector as recited in claim 18, wherein each lateral neck is oriented in the same direction.

20. The sparse acoustic reflector as recited in claim 18, wherein the lateral necks of adjacent Helmholtz resonators are coplanar.

* * * * *